US008144878B2

(12) United States Patent
Chen

(10) Patent No.: US 8,144,878 B2
(45) Date of Patent: Mar. 27, 2012

(54) FM RECEIVER AND PILOT DETECTOR THEREOF, AND METHOD FOR DETERMINING A TYPE OF A PROCESSED SIGNAL

(75) Inventor: Chieh Hung Chen, Kaohsiung (TW)

(73) Assignee: MediaTek Inc., Hsinchu (TW)

( * ) Notice: Subject to any disclaimer, the term of this patent is extended or adjusted under 35 U.S.C. 154(b) by 1500 days.

(21) Appl. No.: 11/369,067

(22) Filed: Mar. 6, 2006

(65) Prior Publication Data

US 2007/0223707 A1 Sep. 27, 2007

(51) Int. Cl.
*H04H 5/00* (2006.01)

(52) U.S. Cl. ..... 381/12

(58) Field of Classification Search ..... 381/1–4, 381/15, 11–13; 455/205
See application file for complete search history.

(56) References Cited

U.S. PATENT DOCUMENTS

| | | | | |
|---|---|---|---|---|
| 3,934,092 | A | 1/1976 | Csicsatka | |
| 3,943,294 | A | 3/1976 | Dorren | |
| 3,999,132 | A | 12/1976 | Smith | |
| 4,056,685 | A | 11/1977 | Burgyan | |
| 4,124,779 | A | 11/1978 | Berens et al. | |
| 4,159,398 | A * | 6/1979 | Hilbert et al. | 381/16 |
| 4,197,496 | A | 4/1980 | Hiyama | |
| 4,225,751 | A | 9/1980 | Hershberger | |
| 4,323,731 | A | 4/1982 | Hershberger | |
| 4,339,772 | A | 7/1982 | Eilers et al. | |
| 4,368,355 | A | 1/1983 | Ichikawa | |
| 4,405,944 | A | 9/1983 | Eilers et al. | |
| 4,420,658 | A | 12/1983 | Loughlin | |
| 4,441,199 | A | 4/1984 | Chester et al. | |
| 4,442,518 | A | 4/1984 | Morimoto | |
| 4,489,431 | A | 12/1984 | Ecklund | |
| 4,523,328 | A | 6/1985 | Kasperkovitz | |
| 4,700,390 | A | 10/1987 | Machida | |
| 4,768,186 | A | 8/1988 | Bodell | |

(Continued)

FOREIGN PATENT DOCUMENTS

JP 61-062248 * 3/1986

(Continued)

OTHER PUBLICATIONS

Bin, Tian, "Non-parametric Binary Rank Detector," *Acta Electronica Sinica*, No. 1, pp. 98-100 (Jan. 1981).

(Continued)

*Primary Examiner* — Xu Mei
*Assistant Examiner* — Lun-See Lao
(74) *Attorney, Agent, or Firm* — Patterson Thuente Christensen Pedersen, P.A.

(57) ABSTRACT

An FM receiver and a pilot detector thereof, and a method for determining a type of a processed signal are provided. The FM receiver comprises a demodulator, a band pass filter (BPF), and a pilot detector. The demodulator generates a multiplexed (MPX) signal. The BPF filters the MPX signal to generate a pilot signal. The pilot detector comprises a signal addition device and a comparator. The signal addition device adds the processed signal for a period of time and to generate a result signal in response to the addition. The comparator compares the result signal with a reference to determine whether the type is stereo. The method comprises the steps of: adding the processed signal for a period of time; generating a result signal in response to the addition; and comparing the result signal with a reference to determine whether the type is stereo.

18 Claims, 5 Drawing Sheets

U.S. PATENT DOCUMENTS

| | | | | | |
|---|---|---|---|---|---|
| 4,773,094 | A | | 9/1988 | Dolby | |
| 4,821,322 | A | * | 4/1989 | Bose | 381/13 |
| 4,901,297 | A | | 2/1990 | Komatsu et al. | |
| 4,977,597 | A | | 12/1990 | Horl | |
| 5,001,757 | A | | 3/1991 | Field et al. | |
| 5,008,939 | A | * | 4/1991 | Bose et al. | 381/15 |
| 5,202,924 | A | | 4/1993 | Richards, Jr. | |
| 5,222,144 | A | | 6/1993 | Whikehart | |
| 5,255,319 | A | | 10/1993 | Nakamura et al. | |
| 5,337,196 | A | | 8/1994 | Kim | |
| 5,359,661 | A | * | 10/1994 | Manlove et al. | 381/15 |
| 5,440,586 | A | | 8/1995 | Den Braber | |
| 5,491,839 | A | | 2/1996 | Schotz | |
| 5,590,203 | A | | 12/1996 | Matsui | |
| 5,802,173 | A | | 9/1998 | Hamilton-Piercy et al. | |
| 5,809,395 | A | | 9/1998 | Hamilton-Piercy et al. | |
| 5,966,400 | A | | 10/1999 | Den Braber | |
| 6,351,631 | B1 | | 2/2002 | Noeske et al. | |
| 6,978,026 | B2 | | 12/2005 | Hildebrandt et al. | |
| 2005/0074075 | A1 | | 4/2005 | Miyagi | |
| 2006/0208933 | A1 | | 9/2006 | Chen et al. | |

FOREIGN PATENT DOCUMENTS

| | | |
|---|---|---|
| TW | 453043 | 9/2001 |
| TW | I249903 | 2/2006 |

OTHER PUBLICATIONS

Zhanrong, Jing, et al., "Teaching Materials of Higher Educational Institutions—Signal Detection and Estimation," *Chemical Industry Press*, Sep. 2004, pp. 222-224.

* cited by examiner

FM RECEIVER AND PILOT DETECTOR THEREOF, AND METHOD FOR DETERMINING A TYPE OF A PROCESSED SIGNAL

CROSS-REFERENCES TO RELATED APPLICATIONS

Not applicable

BACKGROUND OF THE INVENTION

1. Field of the Invention

The present invention relates to an FM receiver and a pilot detector thereof, and a method for determining a type of a processed signal; in particular, relates to an FM receiver and a pilot detector thereof, and a method for determining whether a processed signal is stereo or mono.

2. Descriptions of the Related Art

Frequency modulation (FM) signals are frequently used for the purpose of wireless communications. Each FM signal carries a pilot signal at a certain frequency, e.g., 19 kHz to indicate that an audio signal demodulated from the FM signal is stereo or mono.

FIG. 1 shows a FM receiver 1 which comprises a selection circuit 101, a high frequency (HF) amplifier 103, a mixer 105, an intermediate frequency (IF) amplifier 107, an FM demodulator 109, a stereo decoder 111, a loudspeaker 113, and an antenna 115. There are many radio waves at different frequencies in the air, and the selection circuit 101 is configured to select a preferred channel and receive an HF signal in the preferred channel from the antenna 115. Generally speaking, the HF signal is too weak after a long distance transmission to be demodulated correctly. The HF amplifier 103 is configured to amplify the weak HF signal. Then the frequency of the HF signal is mixed by the mixer 105. The intermediate frequency of the HF signal is amplified by the IF amplifier 107. The HF signal is down converted to be an IF signal thereby. The FM demodulator 109 demodulates the IF signal to generate a multiplexed signal. Then the stereo decoder 111 analyzes the type of the multiplexed signal and decodes the multiplexed signal into a mono audio signal or a stereo audio signal according to its type. The loudspeaker 113 is configured to play sound in response to the audio signal.

To analyze the type of the multiplexed signal, the stereo detector 111 needs a pilot detector. FIG. 2 shows an operating environment of a conventional pilot detector 23. A multiplexed signal 202, such as the multiplexed signal generated from the FM demodulator 109, is filtered by a band pass filter (BPF) 21. The band pass filter 21 has a center frequency of 19 kHz to retrieve a pilot signal 204 out from the multiplexed signal 202. The pilot detector 23 comprises a hysteresis comparator 201. The pilot signal 204 is transmitted to the hysteresis comparator 201 to compare with a reference 206. With hysteresis, noise can be removed during the comparison. If a peak value of the pilot signal 204 is larger than or equal to the reference 206, an indication signal 208 of the hysteresis comparator 201 goes to, for example, a high level in order to notify the stereo decoder 111 that the multiplexed signal 202 is stereo. Otherwise, the indication signal 208 goes to a low level in order to notify the stereo decoder 111 that the multiplexed signal 202 is mono.

However, if the filter quality of the band pass filter 21 is not good or the noise is too serious, the pilot signal 204 will not be retrieved clearly enough for the pilot detector 23 to correctly determine the type of the multiplexed signal 202. In other words, the stereo decoder 111 might utilize an inappropriate decoding process to decode the multiplexed signal 202 so that the audio signal cannot be converted to distinguishable sound.

To solve the problem, a pilot detector which may determine a type of a signal correctly is needed in the industrial field.

SUMMARY OF THE INVENTION

An object of this invention is to provide a pilot detector for determining a type of a processed signal. The pilot detector comprises a signal addition device and a comparator. The signal addition device is configured to add the processed signal for a period of time and to generate a result signal in response to the addition. The comparator is configured to compare the result signal with a reference to determine whether the type is stereo.

Another object of this invention is to provide a method for determining a type of a processed signal. The method comprises the steps of: adding the processed signal for a period of time; generating a result signal in response to the addition; and comparing the result signal with a reference to determine whether the type is stereo.

Another object of this invention is to provide a FM receiver. The FM receiver comprises a demodulator, a band pass filter, and a pilot detector. The demodulator is configured to generate a multiplexed (MPX) signal. The band pass filter is configured to filter the MPX signal to generate a pilot signal. The pilot detector is configured to monitor the pilot signal for a period of time to determine whether the MPX signal is stereo.

Yet a further object of this invention is to provide a pilot detector for determining a type of a processed signal. The pilot detector comprises means for adding the processed signal for a period of time; means for generating a result signal in response to the addition; and means for comparing the result signal with a reference to determine whether the type is stereo.

The present invention has the advantage of precise determination of the type of the processed signal.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
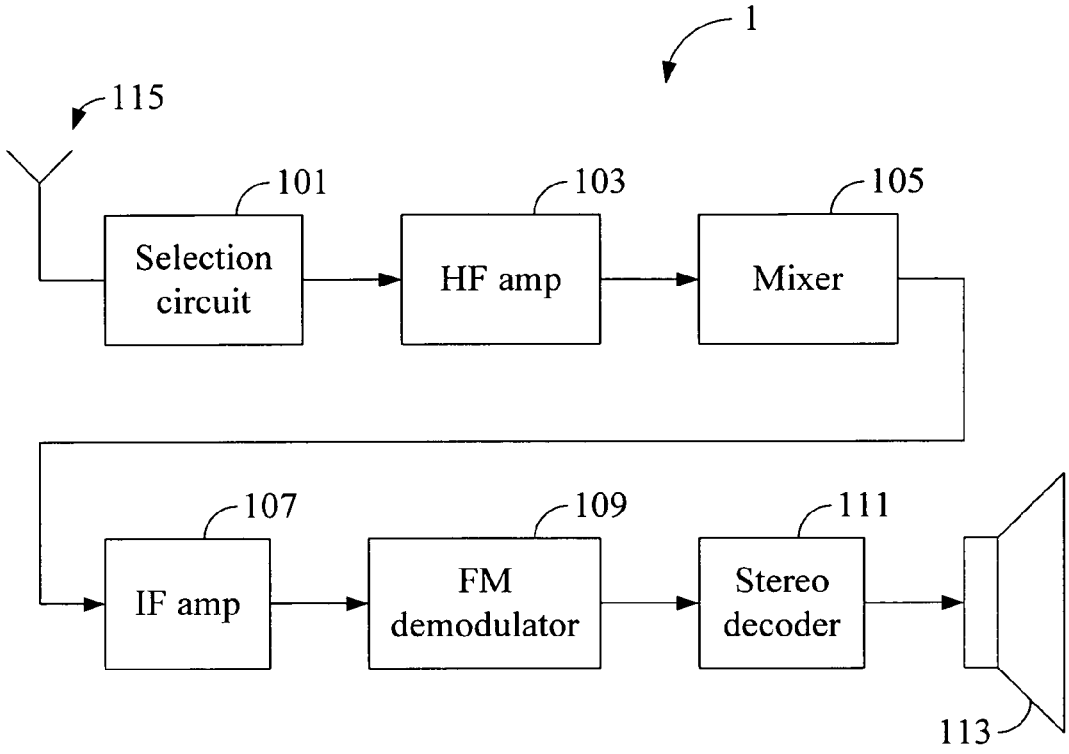
FIG. 1 (prior art)
FIG. 1 shows a FM receiver of the prior art.
Figure 2:
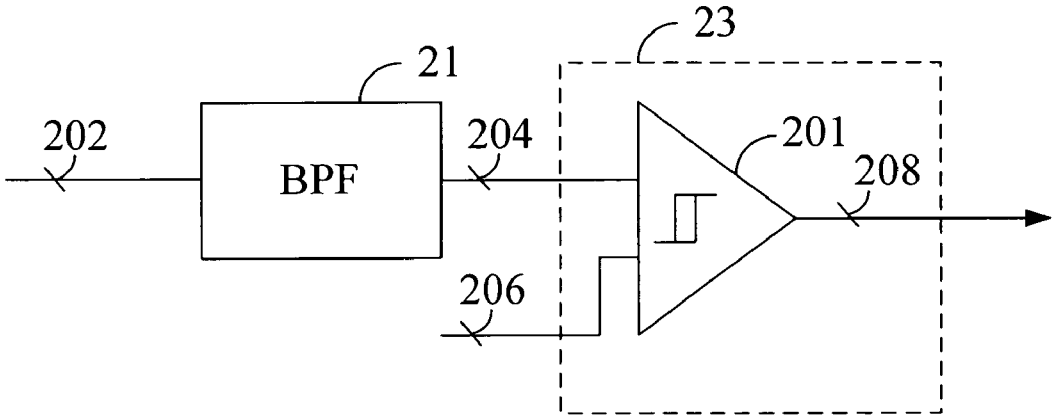
FIG. 2 (prior art)
FIG. 2 shows an operating environment of a pilot detector of the prior art.
Figure 3:
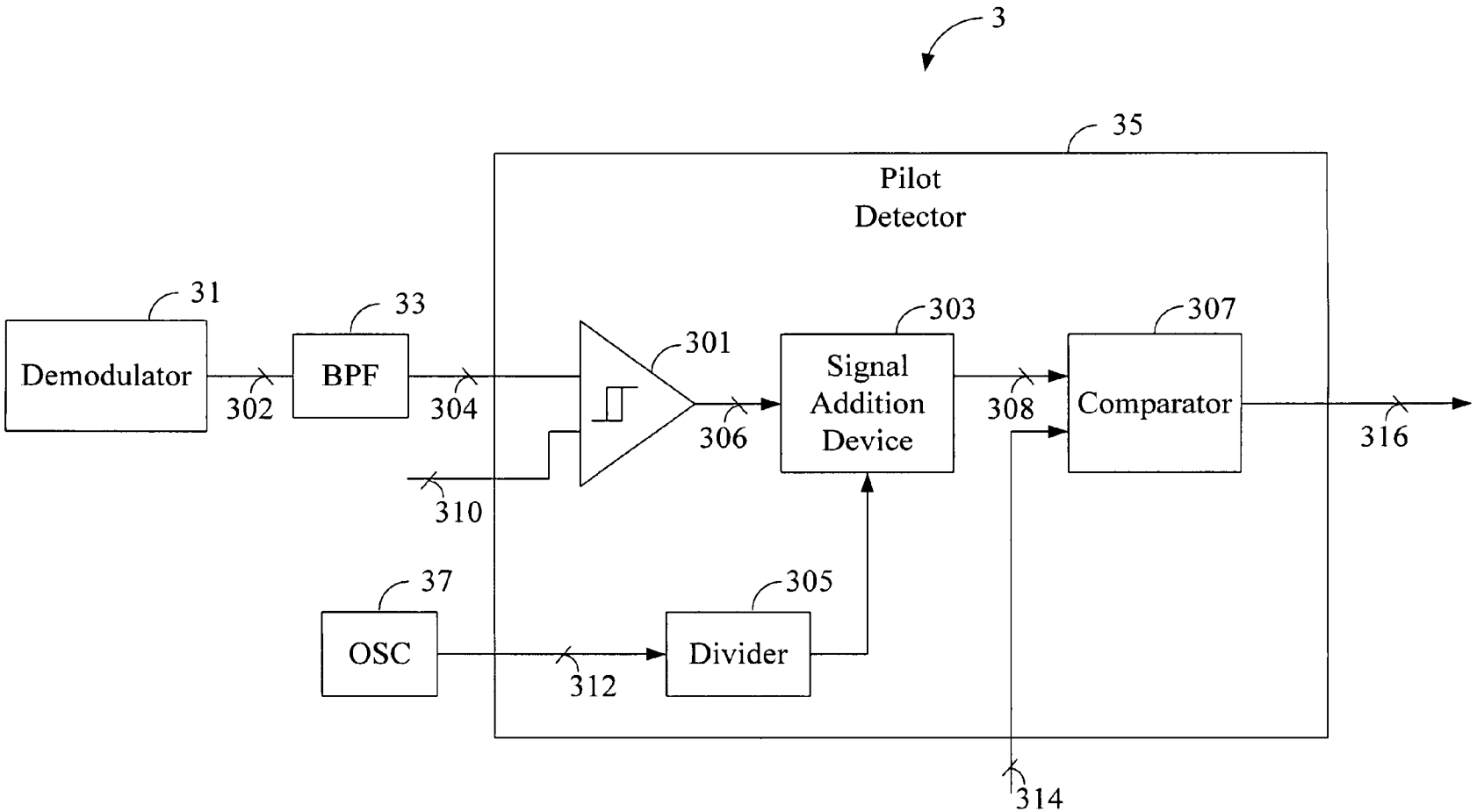
FIG. 3 shows a first embodiment in accordance with the present invention.

A first embodiment of the present invention is an FM receiver 3 as shown in FIG. 3. The FM receiver 3 comprises a demodulator 31, a band pass filter 33, and a pilot detector 35. The demodulator 31 generates a MPX signal 302, wherein the demodulator 31 is configured to perform FM demodulation in this embodiment. The MPX signal 302 is then transmitted to the band pass filter 33 of which a center frequency is set at 19 KHz and a bandwidth is around few KHz in this embodiment. In other embodiments, the bandwidth can be selected from few hertz to few kilo-hertz, even few mega-hertz. The operating frequency in this embodiment is just for exemplar purposes only but is not limited to it. After being filtered by the band pass filter 33, a pilot signal 304 is generated. The pilot detector 35 is configured to monitor the pilot signal 304 for a period of time to determine a type of the MPX signal 302; more particular, to determine whether the MPX signal 302 is mono or stereo.

The pilot detector 35 comprises a hysteresis comparator 301, a signal addition device 303, a divider 305, and a comparator 307. The hysteresis comparator 301 is configured to compare whether a value of the pilot signal 304 is larger than a threshold 310. In this embodiment, the threshold 310 corresponds to a hysteresis range of the hysteresis comparator 301. After the comparison, a processed signal 306 is generated.

Figure 4A:
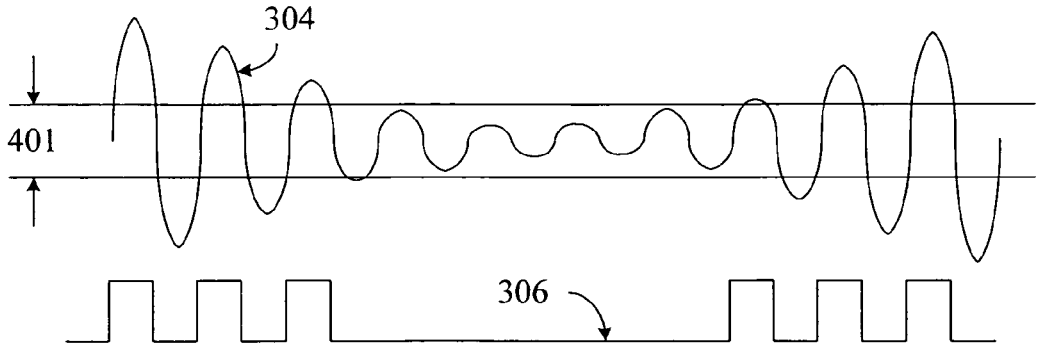
FIG. 4A shows a timing diagram to illustrate the operations of the hysteresis comparator of the first embodiment when a MPX signal is stereo.
Figure 4B:
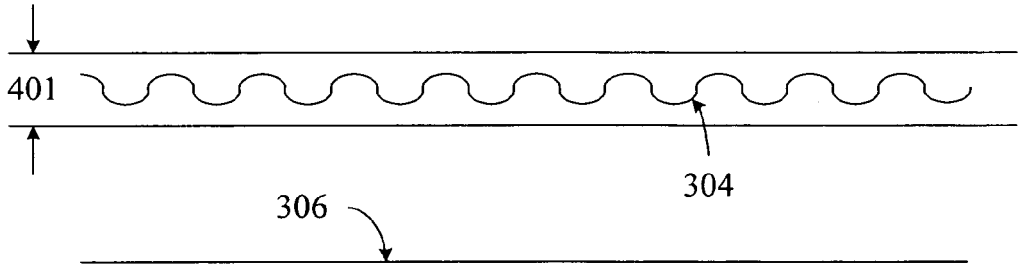
FIG. 4B shows a timing diagram to illustrate the operations of the hysteresis comparator of the first embodiment when a MPX signal is mono.
Figure 4C:
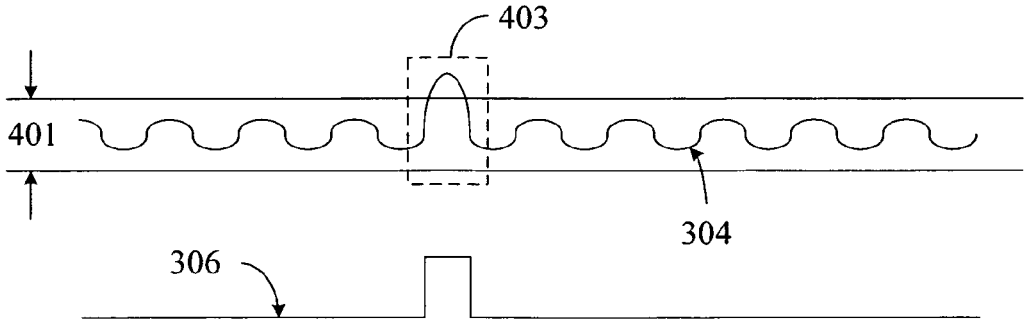
FIG. 4C shows a timing diagram to illustrate the operations of the hysteresis comparator of the first embodiment when a MPX signal is mono but noise exists.

FIG. 4A shows a timing diagram to illustrate the operations of the hysteresis comparator 301 when the MPX signal 302 is stereo, wherein the hysteresis range 401 is set by the threshold 310. The hysteresis range 401 should be set larger than the swing range of the pilot signal 304 when the MPX signal 402 is mono and smaller than the swing range of the pilot signal 304 when the MPX signal 402 is stereo. Each time when the pilot signal 304 exceeds the hysteresis range 401, the processed signal 306 comes with one pulse. FIG. 4B shows a timing diagram to illustrate the operations of the hysteresis comparator 301 when the MPX signal 302 is mono. One can observe that no pulse is generated in the processed signal 306 since the pilot signal 304 never exceeds the hysteresis range 401. FIG. 4C shows a timing diagram to illustrate the operations of the hysteresis comparator 301 when the MPX signal 302 is mono but noise exists in the pilot signal 304. The noise makes the pilot signal 304 to exceed the hysteresis range 401 for one clock, i.e., a block 403. The block 403 results in the generation of one pulse in the processed signal 306.

Referring back to FIG. 3, the processed signal 306 is transmitted to the signal addition device 303. The signal addition device 303 adds the processed signal 306 for a period of time and generates a result signal 308 in response to the addition. The period of time is provided from the divider 305 and is set to be a predetermined value in this embodiment. The predetermined value comes from dividing a clock signal 312. The clock signal 312 is generated from an oscillator 37. The divider 305 receives the clock signal 312 and divides it to generate the period of time. After the period of time, the signal addition device 303 resets to add for a next period. The signal addition device 303 may be a counter, a low pass filter, an accumulator or any device capable of responding to the number of the pulses of the processed signal 306. If the signal addition device 303 is a counter, the result signal 308 is a digital number. The digital number responds to the number of the pulses. If the signal addition device 303 is a digital low pass filter, the result signal 308 is a voltage represented by digital number. The level of the voltage responds to the number of the pulses. If the signal addition device 303 is an accumulator, the result signal 308 is a digital number which also responds to the number of the pulses.

The comparator 307, a digital comparator, compares the result signal 308 with a reference 314 to determine the type of the MPX signal 302. The reference 314 is predetermined to be a basis of noise tolerance. If the result signal 308 is larger than the reference 314, it means that the pulses of the processed signal 306 are confident enough to treat the MPX signal 302 as a stereo signal, such as the condition shown in FIG. 4A. The comparator 307, hence, outputs an indication signal 316 with a high level to notify a stereo detector of the FM receiver 3 that the MPX signal 402 is stereo. For example, if the signal addition device 303 is a counter, the result signal 308 is 10 and the reference 314 is 4, the indication signal 316 will be 1 to indicate that the MPX signal 402 is stereo. Otherwise, the MPX signal 302 is treated mono even if there are few pulses in the processed signal 406, such as the condition shown in FIG. 4C. For example, if the signal addition device 303 is a counter, the result signal 308 is 2 and the reference 314 is 4, the indication signal 316 will be 0 to indicate that the MPX signal 402 is mono. The two pulses are regarded as noise.

Figure 5:
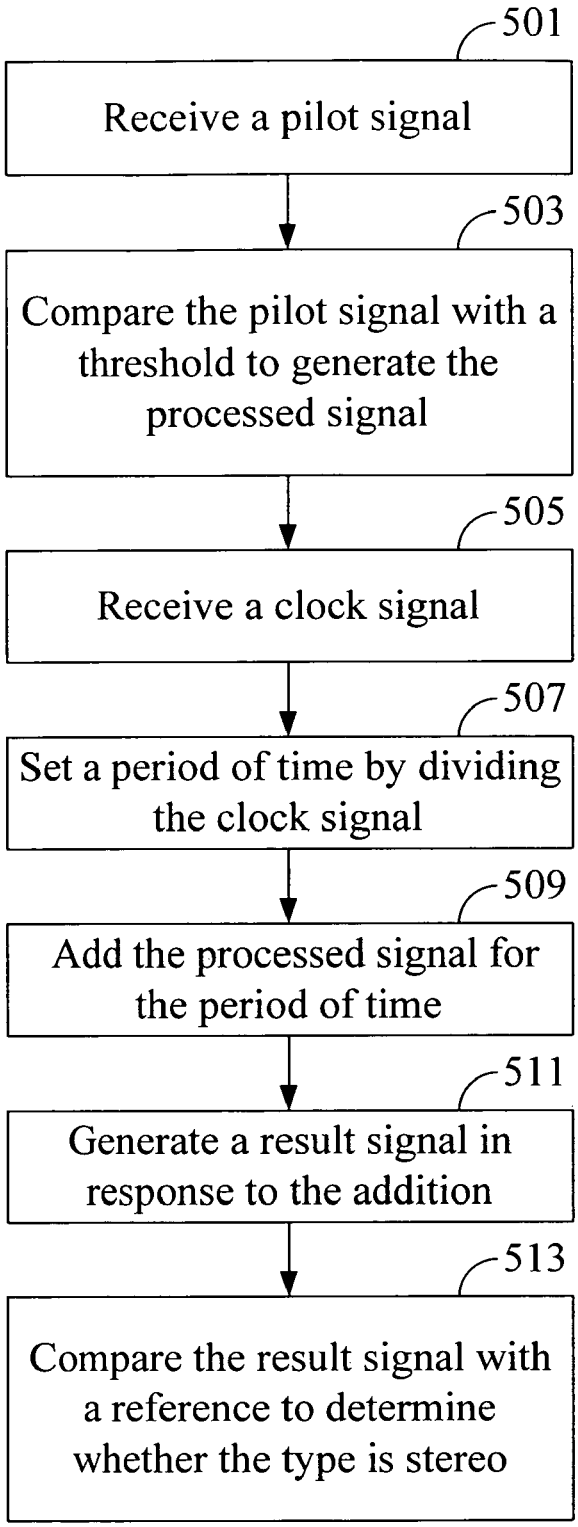
FIG. 5 shows a flow chart of a second embodiment in accordance with the present invention.

A second embodiment of the present invention is a method for determining a type of a processed signal. The second embodiment is adapted for a pilot detector, like pilot detector 35, of a FM receiver. FIG. 5 shows a flow chart of the second embodiment. In step 501, a hysteresis comparator of the pilot detector receives a pilot signal. In step 503, the hysteresis comparator compares the pilot signal with a threshold to generate the processed signal. Then step 505 is executed in which a divider of the pilot detector receives a clock signal. In step 507, the divider sets a period of time by dividing the clock signal and transmits the divided clock signal to a signal addition device of the pilot signal. Then step 509 is executed in which the signal addition device adds the processed signal for the period of time. In step 511, the signal addition device generates a result signal in response to the addition. In step 513, a comparator of the pilot signal compares the result signal with a reference to determine whether the type is stereo. It is noted that the sequence of the steps is just an example. In other words, the sequence of the steps is not a limitation of the present invention.

Similarly, the signal addition device of the second embodiment may be a counter, a low pass filter, an accumulator or any device capable of responding to the number of the pulses of the processed signal 306 as recited in the first embodiment. Furthermore, the second embodiment may perform all of the operations recited in the first embodiment.

The present invention is capable of detecting the above-mentioned processed signal for a period of time to ensure whether the MPX signal is indeed stereo or mono but influenced by noise. Therefore, apparatuses using the present invention may reduce the probability of erroneous determination in the type of MPX signals.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A pilot detector for determining a type of a pilot signal, comprising:

a hysteresis comparator for receiving the pilot signal from a filter and comparing the pilot signal with a threshold to generate a processed signal;

a signal addition device for adding up the pulses of the processed signal to generate a result signal for a period of time; and a comparator for comparing the result signal with a reference to determine whether the type is stereo.

2. The pilot detector as claimed in claim 1, wherein the pilot detector receives a clock signal, and the pilot detector further comprises a divider for setting the period of time by dividing the clock signal.

3. The pilot detector as claimed in claim 1, wherein the filter is a band pass filter.

4. The pilot detector as claimed in claim 1, wherein the pilot detector receives a clock signal, and the pilot detector further comprises a divider for setting the period of time by dividing the clock signal.

5. The pilot detector as claimed in claim 1, wherein the signal addition device is a counter, and the result signal is a digital number.

6. The pilot detector as claimed in claim 1, wherein the signal addition device is a low pass filter, and the result signal is a voltage.

7. The pilot detector as claimed in claim 1, wherein the signal addition device is an accumulator, and the result signal is a digital number.

8. A method for determining a type of a pilot signal, comprising the steps of:

comparing the pilot signal with a threshold to generate a processed signal, wherein the pilot signal is filtered by a filter before the step of comparing;

adding up the pulses of the processed signal to generate a result signal for a period of time; and comparing the result signal with a reference to determine whether the type is stereo.

9. The method as claimed in claim 8, wherein the method further comprises the steps of:

receiving a clock signal; and setting the period of time by dividing the clock signal.

10. The method as claimed in claim 8, wherein the filter is a band pass filter.

11. The method as claimed in claim 8, wherein the method further comprises the steps of:

receiving a clock signal; and setting the period of time by dividing the clock signal.

12. The method as claimed in claim 8, wherein the method further comprises the step of:

providing a counter;

wherein the step of adding the processed signal for a period of time is executed by the counter, and the result signal is a digital number.

13. The method as claimed in claim 8, wherein the method further comprises the step of:

providing a low pass filter;

wherein the step of adding the processed signal for a period of time is executed by the low pass filter, and the result signal is voltage.

14. The method as claimed in claim 8, wherein the method further comprises the step of:

providing an accumulator;

wherein the step of adding the processed signal for a period of time is executed by the accumulator, and the result signal is a digital number.

15. A pilot detector for determining a type of a pilot signal, comprising:

means for comparing the pilot signal with a threshold to generate a processed signal, wherein the pilot signal is filtered by a filter before the means for comparing;

means for adding up the pulses of the processed signal to generate a result signal for a period of time; and means for comparing the result signal with a reference to determine whether the type is stereo.

16. The pilot detector as claimed in claim 15, further comprising:

means for receiving a clock signal; and means for setting the period of time by dividing the clock signal.

17. The pilot detector as claimed in claim 15, wherein the filter is a band pass filter.

18. The pilot detector as claimed in claim 15, further comprising:

means for receiving a clock signal; and means for setting the period of time by dividing the clock signal.

* * * * *